US005201217A

United States Patent [19]

Wachi

[11] Patent Number: 5,201,217

[45] Date of Patent: Apr. 13, 1993

[54] CONTROL DEVICE FOR AN INTERNAL COMBUSTION ENGINE

[75] Inventor: Satoshi Wachi, Himeji, Japan

[73] Assignee: Mitsubishi Denki Kabushiki Kaisha, Tokyo, Japan

[21] Appl. No.: 826,038

[22] Filed: Jan. 27, 1992

[30] Foreign Application Priority Data

Feb. 26, 1991 [JP] Japan ..... 3-030719

[51] Int. Cl.[5] ..... G01M 15/00

[52] U.S. Cl. ..... 73/118.2; 73/204.19

[58] Field of Search ..... 73/118.2, 116, 117.2, 73/204.19

[56] References Cited

U.S. PATENT DOCUMENTS 4,716,876 1/1988 Shimomura et al. ..... 73/118.2
4,719,890 1/1988 Wataya et al. ..... 73/118.2
4,807,581 2/1989 Nishikawa et al. ..... 73/118.2
4,889,101 12/1989 Schifferl ..... 73/118.2

FOREIGN PATENT DOCUMENTS 0064664 11/1982 European Pat. Off. .

*Primary Examiner*—Jerry W. Myracle
*Attorney, Agent, or Firm*—Sughrue, Mion, Zinn, Macpeak and Seas

[57] ABSTRACT

A control device for an internal combustion engine includes a hot-wire type air flow sensor 2 having a temperature dependent resistance. A counter 905d determines whether a predetermined time has elapsed from power ON or startup, and an upper limit is applied to the sensed average air flow quantity until the predetermined time has elapsed, thereby avoiding erroneous fuel injector pulse width calculations during a warmup period of the air flow sensor resistance.

1 Claim, 6 Drawing Sheets

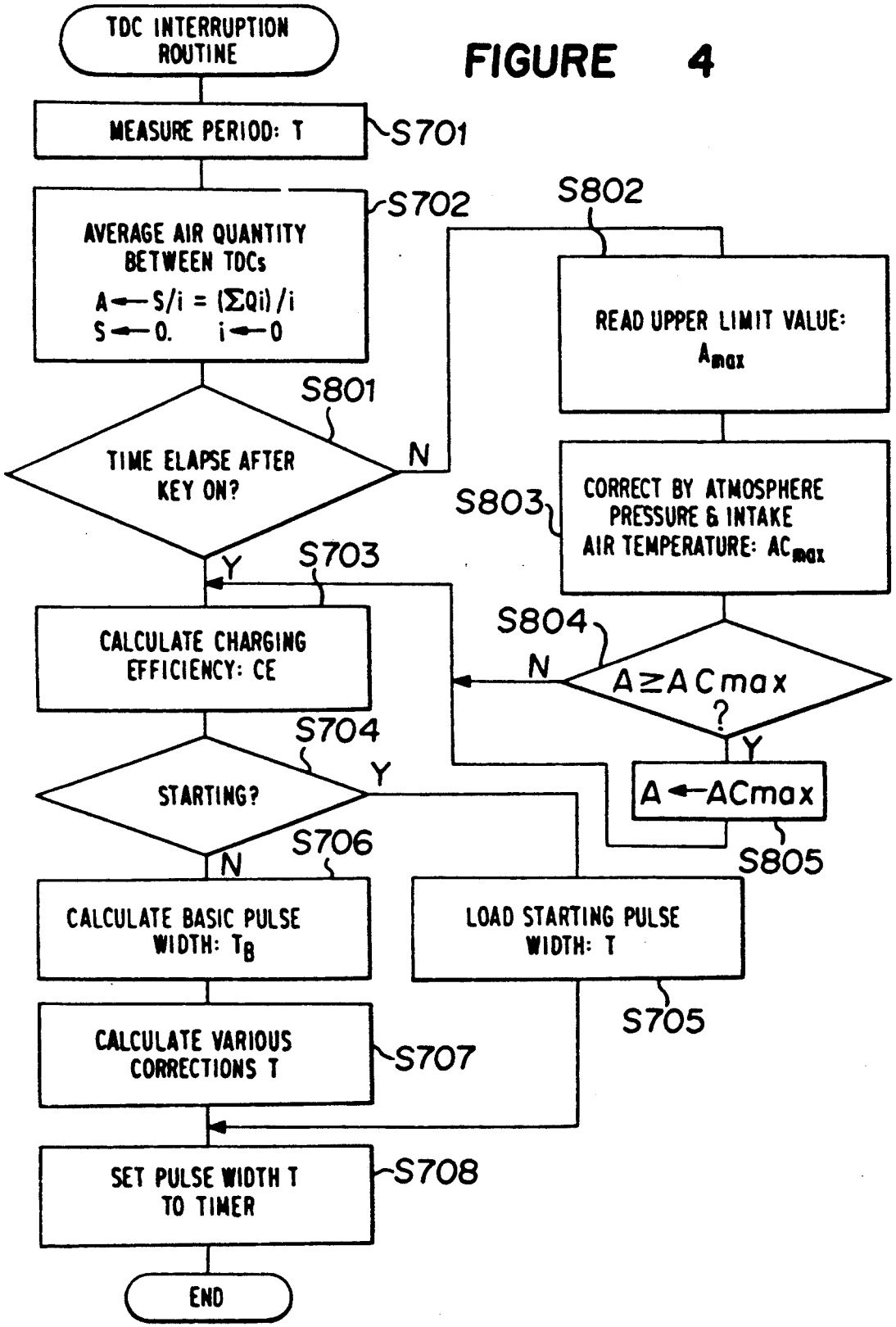
TDC INTERRUPTION ROUTINE
FIGURE 4
MEASURE PERIOD: T
S701
AVERAGE AIR QUANTITY BETWEEN TDCs
A ← S/i = (ΣQi)/i
S ← 0. i ← 0
S702
S802
READ UPPER LIMIT VALUE: Amax
S801
TIME ELAPSE AFTER KEY ON?
N
Y
S803
CORRECT BY ATMOSPHERE PRESSURE & INTAKE AIR TEMPERATURE: ACmax
S703
CALCULATE CHARGING EFFICIENCY: CE
S804
A≥ACmax ?
N
Y
A ← ACmax
S805
S704
STARTING?
Y
N
S706
CALCULATE BASIC PULSE WIDTH: TB
LOAD STARTING PULSE WIDTH: T
S705
CALCULATE VARIOUS CORRECTIONS T
S707
SET PULSE WIDTH T TO TIMER
S708
END

CONTROL DEVICE FOR AN INTERNAL COMBUSTION ENGINE

BACKGROUND OF THE INVENTION

1. Field of the Invention

This invention relates to a control device for an internal combustion engine which performs an optimum control of the internal combustion engine utilizing a hot-wire type air-flow sensor having a temperature dependent resistance.

2. Discussion of Background

FIG. 5 is a diagram showing a general construction of a control device for an internal combustion engine utilizing a hot-wire type air-flow sensor (hereinafter, AFS) having a temperature dependent resistance. In FIG. 5, a reference numeral 1 designates an air cleaner, 2, a hot-wire type air-flow sensor, 3, a throttle valve for controlling intake air quantity of an engine, 4, a surge tank, and 5, an intake (air sucking) manifold.

A numeral 6 designates an intake valve driven by a cam (not shown), and 7, a cylinder. Although only a portion of a single cylinder of the engine is shown in the diagram for simplification, the engine is actually composed of a plurality of cylinders.

A numeral 8 designates an injector in the respective cylinder 7, and 9, an electronic control unit (hereinafter, ECU) for controlling the fuel injection quantity of the injector 8 so that the fuel injection quantity and sucked air quantity compose a predetermined air fuel (A/F) ratio.

This ECU 9 determines the fuel injection quantity based on output signals of the AFS 2, a crank angle sensor 10, a starting switch sensor 11, and a cooling water temperature sensor 12 of the engine, and controls the fuel injection pulse width of the injector 8, in synchronism with the signal of the crank angle sensor 10.

The crank angle sensor 10 may be a well-known one which generates a square wave signal that falls at TDC (top dead center) and rises at BDC (bottom dead center) in the rotation of the engine.

FIG. 6 is a block diagram for explaining more in detail of the operation of the ECU 9. In a revolution number detecting unit 9*a*, the revolution number is obtained by measuring a period between TDCs of the square wave signal from the crank angle sensor 10. An average air quantity detecting unit 9*b* averages the output signal of the AFS 2, between TDCs of the square wave output signal of the crank angle sensor 10. In a basic pulse width calculating unit 9*c*, a basic pulse width is obtained by dividing an average air quantity output of an average air quantity detecting unit 9*b*, by a revolution number output of the revolution number detecting unit 9*a*.

A warming-up correcting unit 9*d*, determines a correction coefficient as for water temperature of the engine obtained by an output of the water temperature sensor 12. A correction calculation unit 9*e* performs the correction by adding or multiplying the correction coefficient to a basic pulse width which is obtained by the basic pulse width calculating unit 9*c*.

The starting pulse width calculating unit 9*f* calculates a starting pulse width which depends on the detected cooling water temperature of the engine. The switch 9*g* selects an injection pulse width or a starting pulse width in response to an output signal of the starting switch sensor 11 which detects the starting time of the engine. A timer 9*h* activates the pulse width in one shot operation at a timing when an output signal of the crank angle sensor 10 falls at TDC. An injector drive circuit 9*i* drives the injector 8.

FIG. 7 shows change of the intake air quantity at the starting time just after power ON, wherein the bold line curve A signifies the output signal of the AFS 2, the two dotted chain line curve shows the result of averaging the AFS signal between TDCs and corresponds to an output signal of the average air quantity detecting unit 9*b*, based on which the fuel injection quantity is calculated. The broken line curve C signifies an actual air quantity.

As shown in FIG. 7, it is known that the air quantity signal of the AFS 2 (curve A) just after power ON, exceeds the actual air quantity (curve C).

Since in the hot-wire type AFS, the air quantity is measured by detecting current flow through a temperature dependent resistance that is controlled at a constant temperature, and since the temperature dependent resistance is cooled down just after power ON, the resistance has to be heated to a predetermined temperature, which increases the current flow. Therefore, the air quantity signal of the AFS 2 becomes an abnormal value which is more than the actual air quantity.

Therefore, it is not possible to calculate the fuel injection quantity which is compatible with the actual air quantity, which lowers the controllability of the engine such as in deterioration of the exhaust gas.

Especially, in a hot-wire type AFS wherein platinum wire is wound around a ceramic bobbin, or in a hot-wire type AFS wherein platinum is vapor-deposited on an aluminum substrate or film, the time required for stabilizing the temperature dependent resistance to a predetermined temperature is long (for instance, several seconds) due to its temperature dependent resistance and heat conduction or heat accumulation to a retaining member, which is not negligible in view of the control of the internal combustion engine.

Since the control device for an internal combustion engine utilizing a conventional hot-wire type air-flow quantity sensor, is composed as above, and since the fuel injection quantity or the like is calculated based on the air-flow signal from the AFS, a control which is compatible with the actual air quantity can not be performed just after power ON.

SUMMARY OF THE INVENTION

It is an object of the present invention to provide a control device for an internal combustion engine which can perform a control compatible with the actual air quantity, even when the output of the AFS is abnormal just after power ON.

According to an aspect of the present invention, there is provided a control device for an internal combustion engine which comprises:

a hot-wire type air quantity sensor for measuring an intake air quantity of an internal combustion engine by controlling a heat generating quantity of a temperature dependent resistance;

a revolution period detecting sensor for detecting a revolution period of the internal combustion engine;

an averaging means for obtaining an average air quantity by sampling the intake air quantity in the revolution period detected by the revolution period detecting sensor;

a determining means for determining whether a predetermined time elapses from when power is ON; and means for providing the average air quantity with an upper limit value until the predetermined time determined by the determining means elapses.

BRIEF DESCRIPTION OF THE DRAWINGS

FIG. 4 is a flow chart showing the TDC interruption routine for performing the program of the control device for an internal combustion engine of FIG. 1;

DETAILED DESCRIPTION OF THE PREFERRED EMBODIMENTS

Figure 5:
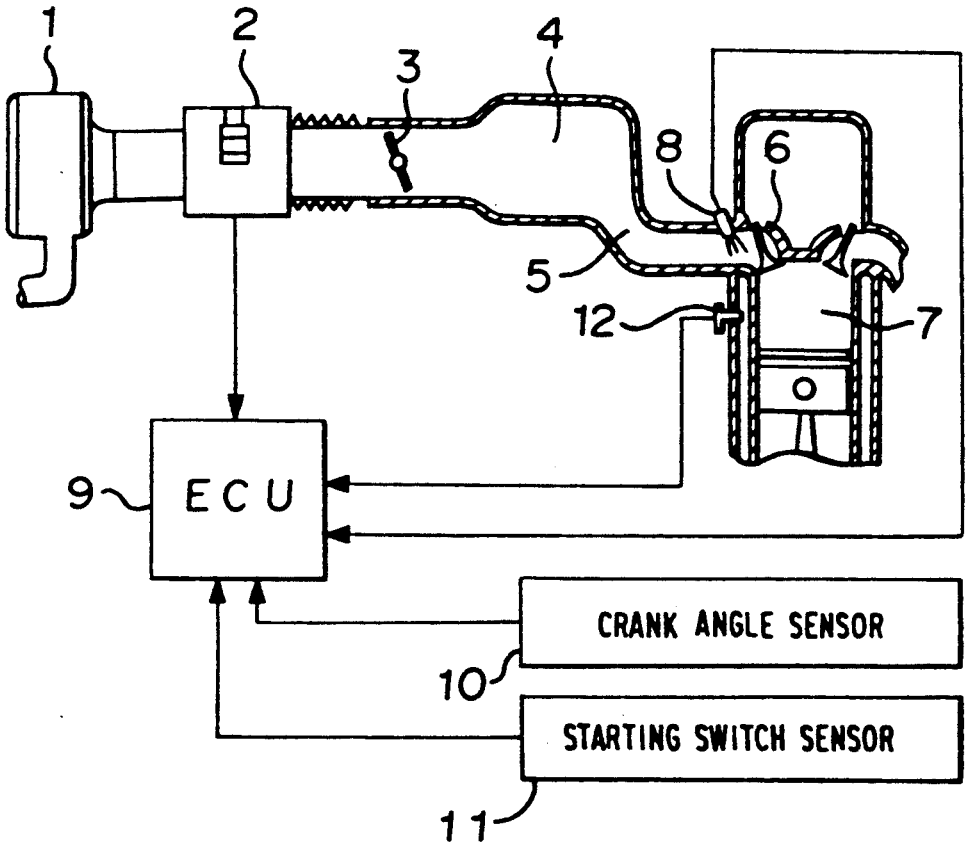
FIGURE 5 PRIOR ART
FIG. 5 is an explanatory diagram showing the construction of the conventional control device for an internal combustion engine.

In the following, explanation will be given to embodiments of the control device for an internal combustion engine according to the present invention based on the drawings. Also in this invention, the general structure of FIG. 5 is utilized. This invention differs with the conventional case in that an ECU 90 is utilized which adopts another control system having a hardware structure of FIG. 1 and a software structure of FIGS. 2 to 4.

Figure 1:
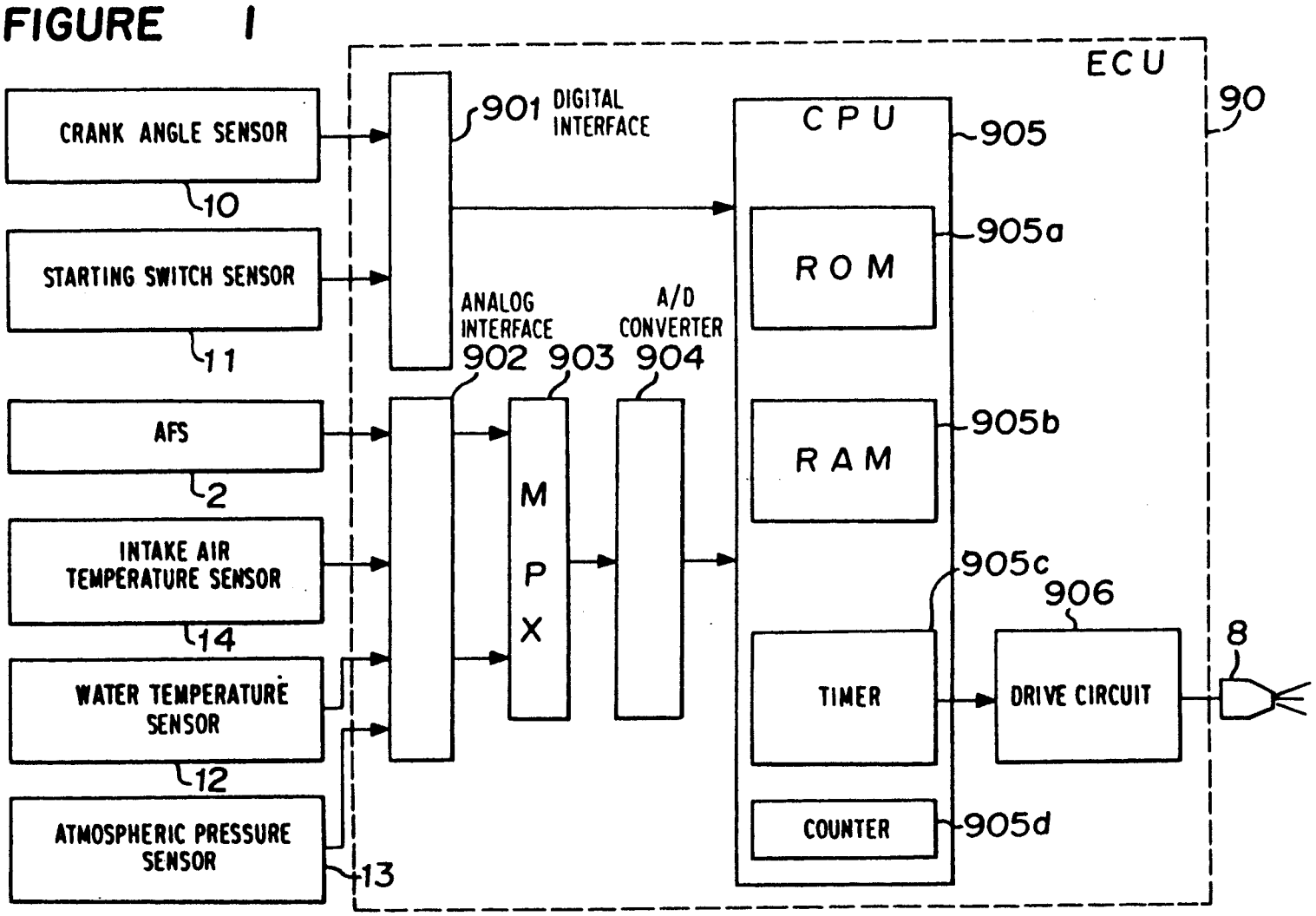
FIG. 1 is a block diagram showing the construction of an embodiment of the control device for an internal combustion engine according to the present invention.

In FIG. 1, a numeral 901 designates an interface circuit of digital inputs of the crank angle sensor 10 and the starting switch sensor 11, 902, an interface circuit of analogue inputs of the AFS 2, the water temperature sensor 12, the atmospheric pressure sensor 13 and the intake air temperature sensor 14, and 903, a multiplexer which outputs outputs of the interface circuit 902 by successively switching them, the analogue inputs of which are converted successively to digital values by an A/D converter 904.

Figure 2:
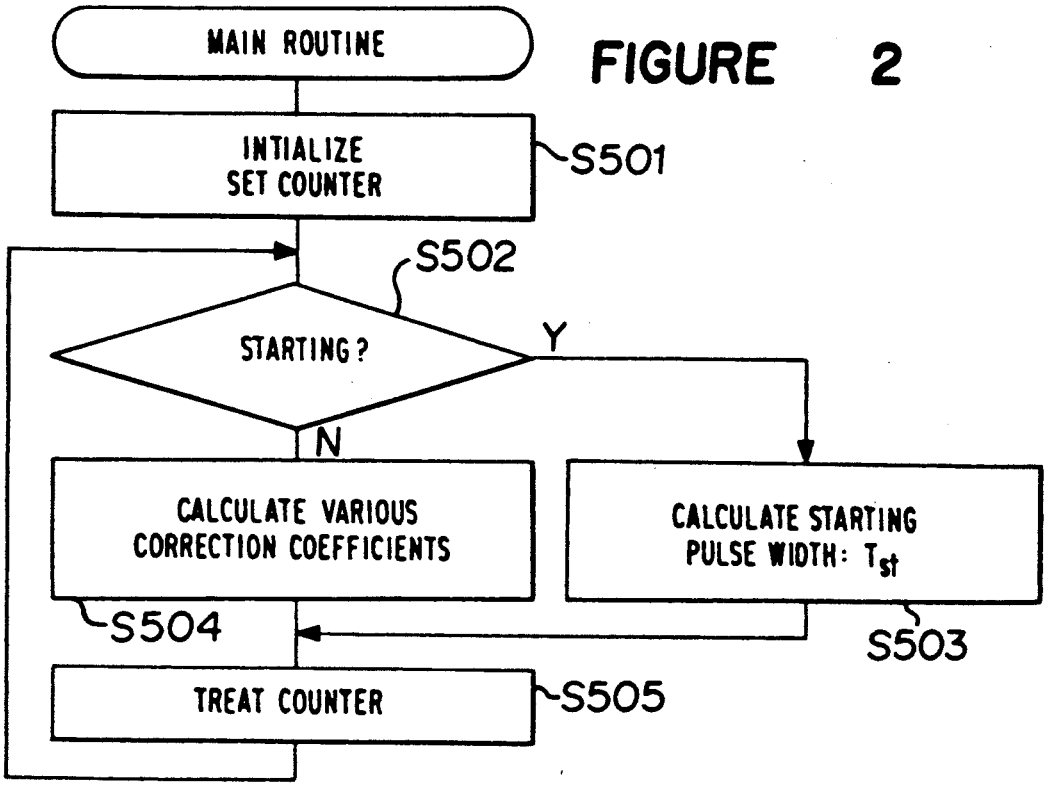
FIG. 2 is a flow chart showing the main routine for performing the program of the control device for an internal combustion engine of FIG. 1.

A numeral 905 designates a CPU which incorporates a ROM 905*a*, a RAM 905*b*, a timer 905*c* and a counter 905*d*, which calculates fuel injection pulse width based on signals inputted from the digital interface circuit 901 and the AD converter 904, by the program operation shown in FIGS. 2 through 4, mentioned later.

A numeral 906 designates an injector drive circuit which drives the injector in the above-mentioned pulse width. This injector drive circuit 906 is the same as the injector drive circuit 9*i* in FIG. 6.

Next, explanation will be given to the operation of the invention by flow charts shown in FIGS. 2 through 4. FIG. 2 is the main routine. The operation performs initialization in step S501, after key ON (power ON), and sets time $T_F$ required for stabilizing the temperature of the temperature dependent resistance of the hot-wire type AFS 2, to the counter 905*d*.

In step S502, the operation determines starting of the engine by the condition of the starting switch sensor 11. When the operation determines that the engine is being started, the operation obtains the starting pulse width $T_{ST}$ based on the water temperature as in the case of FIG. 6, and goes to step S505.

When the operation determines that the engine is not being started, in step S502, the operation calculates various correction coefficients C such as warming-up coefficient, in step S504, and goes to step S505. In step S505, the operation counts down the counter 905*d* by a predetermined amount, and returns to step S502. In the following, the operation repeats the treatments of step S502 and the following steps.

Figure 3:
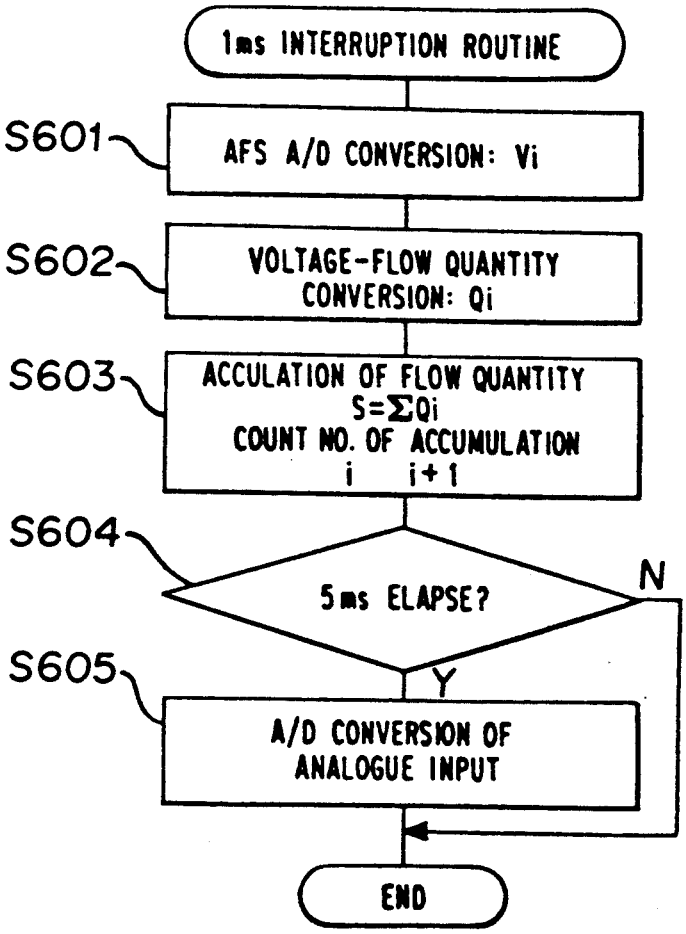
FIG. 3 is a flow chart showing a 1 ms interruption routine for performing programs of the control device for an internal combustion engine of FIG. 1.

FIG. 3 is an interruption treatment routine performed at every 1 ms. The operation inputs the output signal of the AFS 2 to the A/D converter 904 through the interface 902 and the multiplexer 903, and converts them by A/D conversion to thereby obtain a voltage value $V_i$.

Next, the operation obtains a flow quantity $Q_i$ corresponding with the voltage value $V_i$ by looking up a conversion table which is memorized in the ROM 905*a*, in step S602. In step S603, the operation accumulates the flow quantity value $Q_i$ per every 1 ms, and saves the results in the RAM 905*b*, as "S", and saves the number of accumulations in the RAM 905*b* as "i".

In steps S604 and S605, signals of the cooling water temperature, the atmospheric pressure, and the intake air temperature which are analogue inputs other than the AFS signal, are converted in A/D conversion.

FIG. 4 is an interruption treatment routine performed at every TDC of the crank angle signal. In step S701, the operation calculates a period T between TDCs, and goes to step S702. In step 702, the operation obtains an average air quantity A between TDCs by dividing the air quantity S which is accumulated by the 1 ms interruption treatment routine of FIG. 3, by the number of the accumulations i, and thereafter, this value of $S_i$ is set to a memory in the RAM 905*b* wherein $S_i$ is saved.

Next, the operation determines whether a predetermined time $T_f$ elapses after power ON, depending on whether the counter 905*d* is reset (count=0) in step S801. The operation determines that the predetermined time $T_f$ elapses when the counter 905*d* is reset, and goes to step S703.

Moreover, when the counter 905*d* is not reset, the operation determines that the predetermined time $T_f$ has not elapsed, and in step S802, the operation obtains an upper limit value of the air quantity $A_{max}$ which corresponds to the revolution number by reading data memorized in the ROM 905*a*. The operation calculates the value of $AC_{max}$ added with correction based on the atmospheric pressure and the intake air temperature in step S803. In step S804, the operation compares this value with the above mentioned average air quantity A.

When $A \geqq AC_{max}$, as a result of the comparison, the operation clips the mean air quantity A to the value of $AC_{max}$, in step S805. When $A < AC_{max}$, the operation does not clip the average air quantity A. After these steps, the operation goes to step S703.

In step S703, the operation obtains a charging efficiency CE based on the average air quantity A and the period T between TDCs, and goes to S704. In step S704, the operation determines whether the engine is being started. When the engine is being started, the operation goes to step 705, and determines a starting pulse width $T_{ST}$ which is obtained by the main routine of FIG. 2, as an injection pulse width T.

Moreover, when the engine is not being started as the result of the determination of the starting in step S704, the operation goes to step S706 from step S704. In step 706, the operation calculates the basic pulse width based on the charging efficiency CE.

Figure 6:
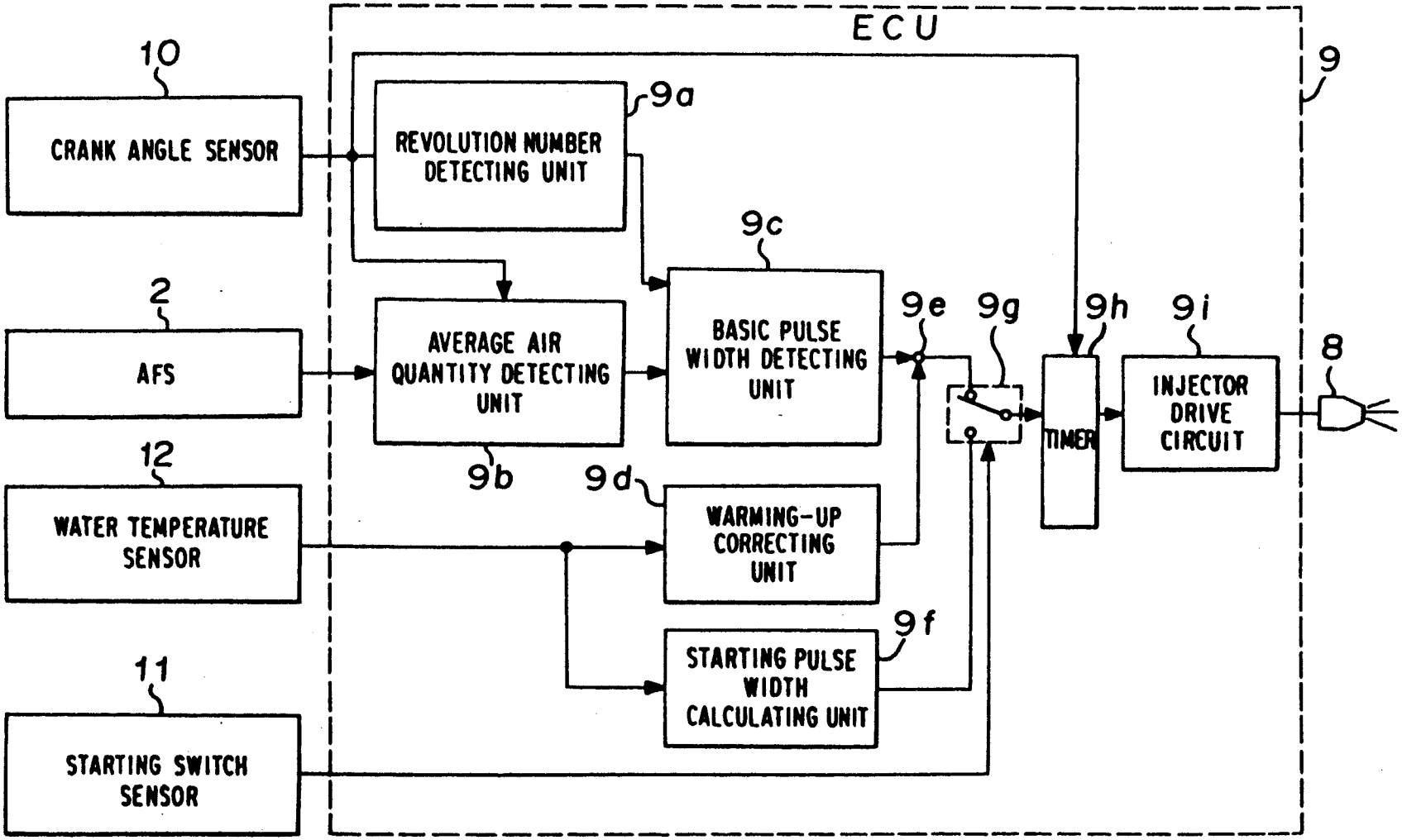
FIG. 6 is a block diagram showing the inner structure of the electronic control unit in the control device for an internal combustion engine of FIG. 5.
Figure 7:
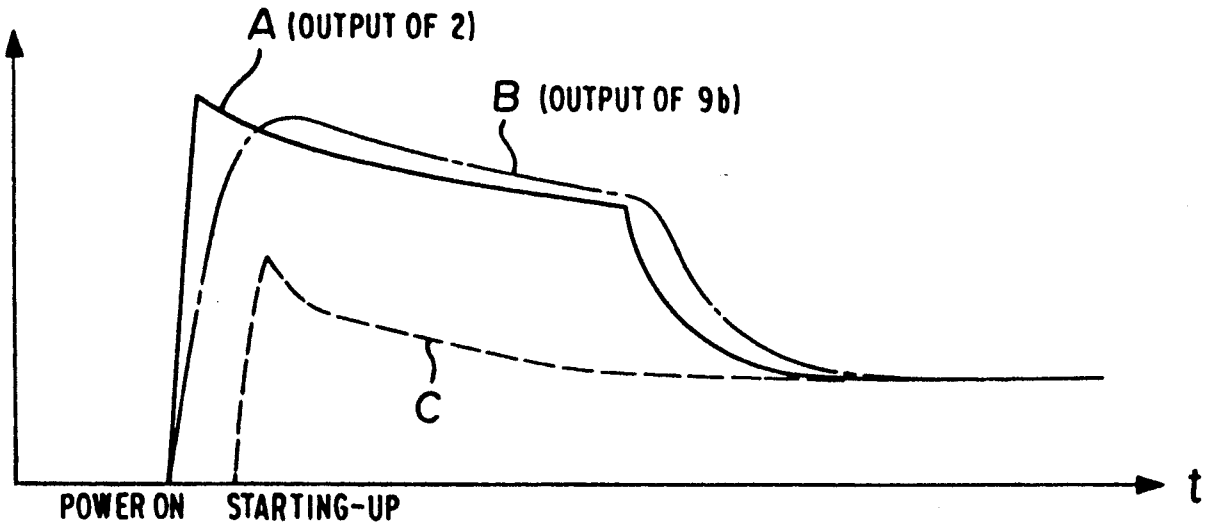
FIGURE 7 PRIOR ART
FIG. 7 is a characteristic diagram for explaining abnormality of output of the hot-wire type AFS just after power ON in the control device for an internal combustion engine of FIG. 5.

Next, in step S707, the operation obtains the injection pulse width T as in the warming-up correction unit 9*d* of FIG. 6, and the operation goes to step S708 from step S707. In step S708, the operation sets the injection pulse width T to the timer 905*c* in the CPU 905.

Moreover, in the above embodiments, the treatment is performed between TDCs. However, the same effect is obtained by performing the treatment in an ignition-to-ignition period.

Furthermore, in the above embodiment, explanation is given to the fuel injection device as an example. However, this invention is applicable to other controls for an internal combustion engine such as an ignition control or a supercharging pressure control.

As mentioned above, this invention is constructed so that an upper limit value is given to the average air quantity which is obtained by the output signal of the hot-wire type AFS during a predetermined time just after power ON. Therefore, this invention has an effect wherein the control of an internal combustion engine can be performed which is compatible with the actual air quantity, even during the period when the output of the hot-wire type AFS is abnormal just after power ON.

What is claimed is:

1. A control device for an internal combustion engine, comprising:

a) a hot-wire type air flow sensor, including a temperature dependent resistance, for measuring an intake air flow quantity of an internal combustion engine;

b) a revolution period detecting sensor for detecting a revolution period of the internal combustion engine;

c) an averaging means for sampling measured intake air flow quantities during each revolution period detected by the revolution period detecting sensor to obtain an average air flow quantity;

d) counter means for determining whether a predetermined time has elapsed since power was switched ON;

e) means for limiting the average air flow quantity to an upper limit value only when the predetermined time determined by the counter means has not elapsed, and not thereafter;

f) means for individually sensing atmospheric pressure and intake air temperature;

g) means for correcting the limited average air flow quantity in accordance with the sensed atmospheric pressure and intake air temperature; and h) means for calculating a fuel injector pulse width based on the corrected limited average air flow quantity to avoid erroneous fuel injector pulse width calculation during an initial warmup period following power ON, during which the air flow sensor resistance is relatively cold and attendantly produces an abnormal, erroneous output.

* * * * *